United States Patent [19]

Wakimoto

[11] Patent Number: 4,547,015

[45] Date of Patent: Oct. 15, 1985

[54] FOLDING CANVAS CHAIR

[76] Inventor: Yasuo Wakimoto, No. 3-6, Nishiasakusa 1-chome, Taito-ku, Tokyo, Japan

[21] Appl. No.: 438,738

[22] Filed: Nov. 3, 1982

[30] Foreign Application Priority Data

Nov. 6, 1981 [JP] Japan ..... 56-164875[U]

[51] Int. Cl.[4] ..... A47C 4/00

[52] U.S. Cl. ..... 297/16; 297/35; 297/45

[58] Field of Search ..... 297/16, 17, 45, 35; 248/164, 431

[56] References Cited

U.S. PATENT DOCUMENTS

| | | | |
|---|---|---|---|
| 1,957,417 | 5/1934 | Williams | 297/35 |
| 2,719,575 | 10/1955 | Smith | 297/35 X |
| 3,124,387 | 3/1964 | Maclaren | 297/16 |
| 3,635,520 | 1/1972 | Roher | 297/45 |
| 4,184,711 | 1/1980 | Wakimoto | 297/16 |
| 4,258,951 | 3/1981 | Groom | 297/16 |

FOREIGN PATENT DOCUMENTS

| | | | |
|---|---|---|---|
| 398345 | 9/1933 | United Kingdom | 297/35 |

*Primary Examiner*—Francis K. Zugel

*Attorney, Agent, or Firm*—Darby & Darby

[57] ABSTRACT

A folding canvas chair includes a pair of improved connecting members of generally L-shape. The connecting members are provided to pivotally connect legs of a chair with a pair of supporting posts supporting the back of a sitting person. The supporting posts can be folded backwardly for an easy hand carrying.

3 Claims, 6 Drawing Figures

FOLDING CANVAS CHAIR

BACKGROUND OF THE INVENTION

This invention relates to a folding canvas chair and, in particular, relates to an improvement of a folding and unfolding mechanism thereof.

Conventional folding canvas chair is constructed to form a vulky shape when folded accompanying a troublesome procedure in handling in the course of folding and unfolding operation by utilizing merely a hing and pivotal coupling mechanism. U.S. Pat. No. 4,184,711 is believed to be the closest prior art to the present invention. Said U.S. Patent in the name of same applicant of this invention is partly successful in solving the above-mentioned disadvantages. However, the construction of the folding and unfolding mechanism disclosed therein is still complicated because of the existence of a strip-like leaf spring having a curved hock portion at the lower extension thereof thus necessitating a manual operation before folding a chair. One of the primary difficulties encountered in simplifying the mechanism is a possible risk endangering stability of the function of a chair.

SUMMARY OF THE INVENTION

It is therefore an object of this invention to provide a canvas chair having a simplified folding and unfolding mechanism without endangering stability of the function of a chair.

Another object of the invention is to provide a canvas chair folded into a compact size for an easy hand-carrying.

A further object of the present invention is to provide a folding canvas chair which is comfortable for a person to sit on.

Still a further object of the invention is to provide a chair which is inexpensive to manufacture.

To accomplish the above and other objects, there is provided a canvas chair comprising a base plate having four apertures formed therethrough; four rods extending through said four apertures, respectively, each of said rods being pivotally connected to said base plate intermediate opposite ends thereof; a pair of connecting members of generally-L shape each having a base portion, said base portions being fixedly secured to the upper ends of two adjacent ones of said four rods, respectively; a pair of parallel spaced webs extending outwardly from the upper end of said base portion; a pair of supporting posts each received between and connected to said webs of a respective one of said connecting members for rearward pivotal movement; and a sheet of canvas having a seat portion and a back portion extending therefrom, two corners of said seat portion remote from said back portion being connected to the upper ends of the other two rods, respectively, said back portion being supported on said supporting posts.

The foregoing and other objects, the features and the advantages of the present invention will be pointed out in, or apparent from, the following description of the preferred embodiment considered together with the accompanying drawings.

BRIEF DESCRIPTION OF THE DRAWINGS

The attached drawings show a folding canvas chair in a form of an embodiment of the present invention, in which.

DETAILED DESCRIPTION OF THE INVENTION

Figure 1:
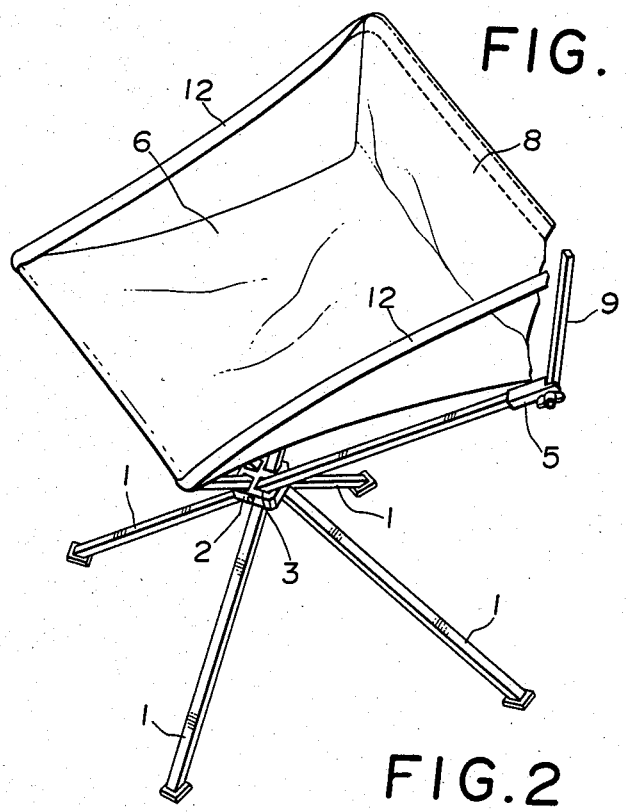
FIG. 1 is a perspective view of the whole body of a set-up folding chair.
Figure 2:
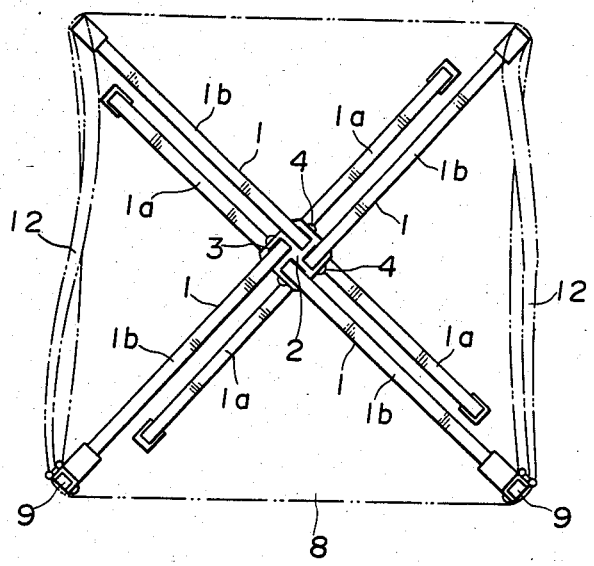
FIG. 2 is a plan view thereof.
Figure 3:
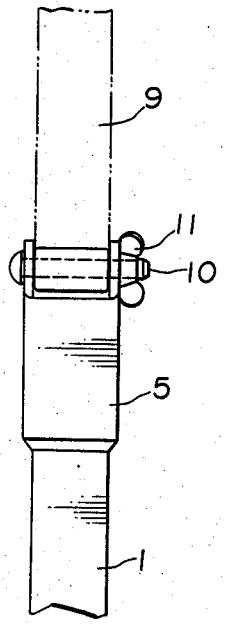
FIG. 3 is a from view of a connecting member coupled with an upper leg in an enlarged scale.
Figure 4:
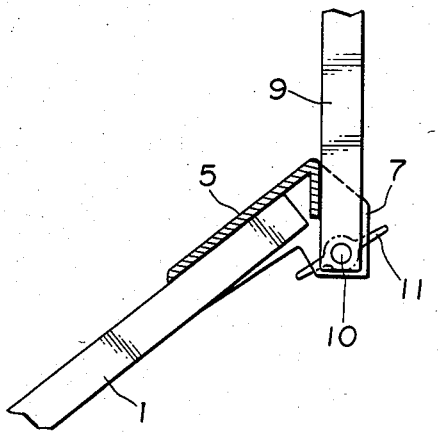
FIG. 4 is a section view of a connecting member in an enlarged scale.

In the drawings, the reference 1 represents four rods for setting up a framework of a chair according to the present invention, and each of said rods is adapted to serve at the lower half thereof as a leg 1*a* of the chair, while at the upper half thereof as a post 1*b* for supporting a sheet of canvas, said sheet having a seat portion 6 and a back portion 8 extending therefrom, 2 designates a base plate having four apertures 3 perforated at predetermined positions thereon for extending said four rods therethrough, respectively. Each of said rods is pivotally connected to said base plate intermediate opposite ends thereof by a pivotal pin 4, and 5 denotes a pair of connecting members of generally-L shape. Each of said connecting members has a base portion being fixedly secured to the upper ends of two adjacent rods 1, respectively, a pair of parallel spaced webs 7 extending outwardly from the upper end of said base portion. Each of a pair of supporting posts 9 is received by said webs of a respective one of said connecting members and is secured at the lower end thereof to the webs by a pin 10 for rearward pivotal movement. A thumbscrew 11 may be applied to said pin 10 for controlling the tightness of securing power so that the most desirable stability of a chair can be obtained. A sheet of canvas having the seat portion 6 and the back portion 8 is connected to the upper ends of the other two rods at two corners of said seat portion remote from said back portion 8 and the back portion 8 is supported on said supporting posts 9. 12 denotes a pair of flexible straps each extending between said corner of said seat portion and the upper corner of said back portion.

Figure 5:
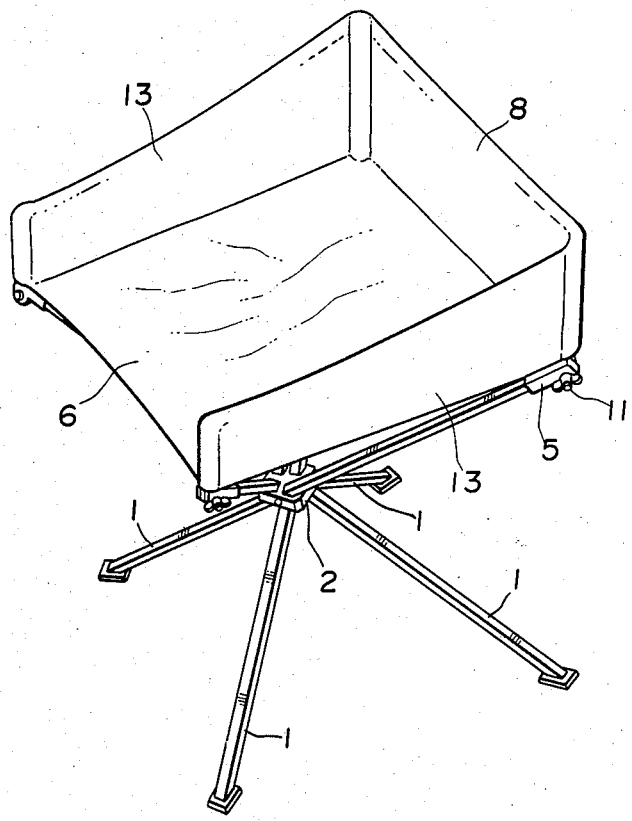
FIG. 5 is a perspective view of another embodiment of a chair shown in FIG. 1 having another pair of connecting members coupled with the upper ends of rods for stretching a pair of arm canvases.
Figure 6:
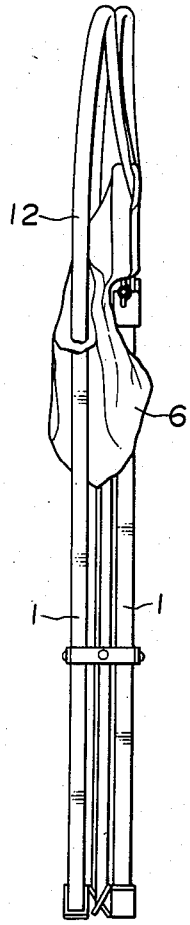
FIG. 6 is a front view of a chair in a closed state.

FIG. 5 illustrates a modified embodiment of the invention in which another pair of connecting members, which are identical in construction to the above-mentioned connecting members 5 are connected to the upper ends of the other two rods, another pair of supporting posts being connected to said another connecting members in the same manner as mentioned above, said another pair of supporting posts being forwardly pivotable, and a pair of arm canvases 13 are stretched between and supported on said another supporting post and the first-mentioned supporting post for providing a comfortable arm chair.

Since the folding canvas chair according to the present invention is set up in the structure as mentioned above, when a person sits on the chair in a set-up state as shown in FIG. 1 reclining his back on the back portion 8, a power is exercised to fall the pair of supporting posts in their axial direction. At the same time, however, since the back portion of the sheet of canvas as well as the pair of straps 12, become tense against the falling power, the posts are stood up straight thus rendering a comfortable sitting condition.

The set-up chair as shown in FIG. 1 can be closed by just pulling up the straps 12 as shown in FIG. 5. It can be further folded to a more compact size by pushing down the pair of supporting posts along the rod 1 as set forth above.

Moreover, since the connecting member 5 is simplified in its construction as mentioned above, the manufacturing cost of the chair becomes low.

Having described my invention as related to the embodiment shown in the accompanying drawings, it is my intention that the invention be not limited by any of details of the description, unless otherwise specified, but rather be construed broadly within its spirit and scope as set out in the accompanying claims.

What is claimed is:

1. A canvas chair comprising:

a base plate having four apertures formed therethrough;

four rods extending through said four apertures, respectively, each of said rods being pivotally connected to said base plate intermediate opposite ends thereof;

a pair of connecting members of generally L shape each having a base portion, said base portions being fixedly secured to the upper ends of two adjacent ones of said four rods, respectively, a pair of parallel spaced webs extending outwardly from the upper end of said base portion;

a pair of supporting posts each received between and connected to said webs of a respective one of said connecting members for rearward pivotal movement; and a sheet of canvas having a seat portion and a back portion extending therefrom, two corners of said seat portion remote from said back portion being connected to the upper ends of the other two rods, respectively, said back portion being supported on said supporting posts, and said canvas sheet having a pair of flexible straps each extending between said corner of said seat portion and the upper corner of said back portion.

2. A canvas chair according to claim 1, in which another pair of connecting members, which are identical in construction to the first-mentioned connecting members, are connected to the upper ends of the other two rods, another pair of supporting posts being connected to said other connecting members in the same manner for the first-mentioned supporting posts, said other pair of supporting posts being forwardly pivotable, and a pair of arm canvases are stretched between and supported on said other supporting post and the first-mentioned supporting post.

3. A canvas chair comprising:

a base plate having four apertures formed therethrough;

four rods extending through said four apertures, respectively, each of said rods being pivotally connected to said base plate intermediate opposite ends thereof;

four connecting members of generally-L shape each having a base portion, said base portions being fixedly secured to the upper ends of four adjacent ones of said four rods, respectively, four parallel spaced webs extending outwardly from the upper end of said base portion;

a pair of rear supporting posts each received between and connected to said webs of a respective one of said connecting members for rearward pivotal movement;

a second pair of front supporting posts each received between and connected to said webs of a respective one of said connecting members for forward pivotable motion;

a sheet of canvas having a seat portion and a back portion extending therefrom, two corners of said seat portion remote from said back portion being connected to the upper ends of the other two rods, respectively, said back portion being supported on said supporting posts; and a pair of arm canvases stretched between and supported on said rear supporting post and the front supporting post.

* * * * *